US008091373B2

(12) United States Patent
Hugghins et al.

(10) Patent No.: US 8,091,373 B2
(45) Date of Patent: Jan. 10, 2012

(54) METHOD OF TWINNING AIR CONDITIONING UNITS

(75) Inventors: Gordon Jeffrey Hugghins, Jacksonville, TX (US); Roger L. Boydstun, Tyler, TX (US)

(73) Assignee: Trane International, Inc., Piscataway, NJ (US)

( * ) Notice: Subject to any disclaimer, the term of this patent is extended or adjusted under 35 U.S.C. 154(b) by 823 days.

(21) Appl. No.: 11/893,332

(22) Filed: Aug. 15, 2007

(65) Prior Publication Data

US 2009/0044552 A1 Feb. 19, 2009

(51) Int. Cl.
*F25B 49/00* (2006.01)

(52) U.S. Cl. ..... 62/125; 62/127; 62/175

(58) Field of Classification Search ..... 62/125, 62/127, 175

See application file for complete search history.

(56) References Cited

U.S. PATENT DOCUMENTS

| | | | | |
|---|---|---|---|---|
| 5,237,826 | A | 8/1993 | Baldwin et al. | |
| 5,276,630 | A | 1/1994 | Baldwin et al. | |
| 5,316,073 | A * | 5/1994 | Klaus et al. | 165/11.1 |
| 5,326,027 | A | 7/1994 | Sulfstede et al. | |
| 5,361,985 | A | 11/1994 | Rein et al. | |
| 5,818,347 | A | 10/1998 | Dolan et al. | |
| 6,098,413 | A * | 8/2000 | Wada | 62/127 |
| 6,698,218 | B2 * | 3/2004 | Goth et al. | 62/175 |
| 6,874,691 | B1 | 4/2005 | Hildebrand et al. | |
| 2003/0041605 | A1 * | 3/2003 | Butcher et al. | 62/175 |
| 2005/0005619 | A1 * | 1/2005 | Kojima et al. | 62/132 |
| 2005/0145705 | A1 * | 7/2005 | Shah et al. | 236/51 |
| 2005/0195757 | A1 * | 9/2005 | Kidder et al. | 370/278 |
| 2005/0207741 | A1 | 9/2005 | Shah et al. | |
| 2006/0123811 | A1 * | 6/2006 | Ha et al. | 62/175 |
| 2007/0068179 | A1 * | 3/2007 | Zikes | 62/175 |

FOREIGN PATENT DOCUMENTS

| | | | |
|---|---|---|---|
| JP | 06213496 | * | 8/1994 |
| JP | 11287507 | * | 10/1999 |

OTHER PUBLICATIONS

JP06213496 and JP11287507 English Translations.*

* cited by examiner

*Primary Examiner* — Cheryl J Tyler
*Assistant Examiner* — Paolo Gonzalez
(74) *Attorney, Agent, or Firm* — Conley Rose, P.C.; J. Robert Brown, Jr.

(57) ABSTRACT

Heating, ventilating and air conditioning (HVAC) equipment units are provided with controllers which may be interconnected to a third or common controller, such as a communicating thermostat, and provide information in a process to determine if two or more of such air conditioning units may be operated as twinned units. Information is transmitted over a data bus between the controllers for the respective air conditioning units and the common controller to determine if the air conditioning units are the same type, of a same family and of essentially the same capacity before permitting twinned operation. If one of the air conditioning units is not twinnable, an alarm signal is generated to prevent operation of the air conditioning units in a multiple-unit configuration.

19 Claims, 2 Drawing Sheets

METHOD OF TWINNING AIR CONDITIONING UNITS

BACKGROUND OF THE INVENTION

Units of heating, ventilating and air conditioning (HVAC) equipment, including variable capacity furnaces for heating enclosed spaces, such as residential dwellings and commercial buildings, have been developed in the interest of providing equipment which is more efficient and provides greater comfort for occupants of such spaces. Variable capacity furnaces, for example, typically include variable speed air circulating blowers and controls for providing heated air at different heat rates and air flow rates.

There are situations wherein the capacity requirements for heating or otherwise air conditioning an enclosed space require so-called twinning of furnaces and other air conditioning equipment, such as air handlers. Twinning typically involves equipment installations where separate multiple air conditioning units are connected to a common temperature controller or thermostat and are operable to discharge heated or cooled air into a common plenum or air supply duct for circulation to an enclosed space. Typically the return air from the enclosed space also flows through a common return air duct or plenum. For such twinning applications, certain types of air conditioning equipment cannot be used since operation of one unit at a specific capacity, for example, may differ from the operating conditions of the other unit or others of multiple units connected to the same ducting system. Accordingly, certain variable capacity units or units of different capacities may not be twinned or ganged since unequal heat output and pressures generated by different air flow rates of the respective units, may cause adverse operating conditions. Thus, it is important to be able to prevent twinning or mismatching of units of air conditioning equipment in applications where multiple units of such equipment have been specified. It is to these ends that the present invention has been developed.

SUMMARY OF THE INVENTION

The present invention provides a method for permitting or prohibiting the so-called twinning of multiple units of air conditioning equipment, particularly combustion furnaces for heating enclosed spaces.

In accordance with one aspect of the present invention, a method is provided for detecting the type of air conditioning equipment connected to a common controller, such as a communicating thermostat, whereby the controller includes a program or is otherwise configured to query a program resident on the controllers for respective units of air conditioning equipment to determine if the air conditioning units are compatible for so-called twinning applications. By way of example, a program may be resident on a thermostat type controller which queries the controllers of respective air conditioning units to which the thermostat controller is connected for determining the operating specifications of the equipment to determine if the respective air conditioning units match in a sense which would permit connecting multiple units to a common air ducting system.

The method of the invention also contemplates providing a controller which will determine if the air heating and/or cooling capacities of the respective air conditioning units destined to be twinned match sufficiently to permit twinning. If neither the specifications nor the capacity parameters of the respective units are matched, the method prevents operation of the units and "publishes" an alarm or fault signal which may be detected at the common controller or on a controller associated with one or more of the air conditioning units.

In accordance with another aspect of the invention, there is provided a method for prohibiting the twinning of air conditioning units wherein a parameter specified in a program which is resident on the controllers for the respective units will indicate immediately, once the units are connected to a common controller, such as a thermostat, that twinning is not allowed.

In accordance with still a further aspect of the invention, there is provided a method of allowing or preventing the twinning of units of air conditioning equipment wherein separate information storage and transmission devices are connected to the controllers of respective units of air conditioning equipment to furnish data indicating whether twinning would be allowed or not allowed, and this data is read by a common controller for the respective air conditioning units to compare information and permit twinning or not permit twinning of the respective units, depending on the identity or type of unit, the respective specifications of the units and the heating and/or cooling capacity of the respective units.

Those skilled in the art will further appreciate the above-mentioned features and advantages of the invention together with other important aspects thereof upon reading the detailed description which follows in conjunction with the drawings.

DETAILED DESCRIPTION OF A PREFERRED EMBODIMENT

Figure 1:
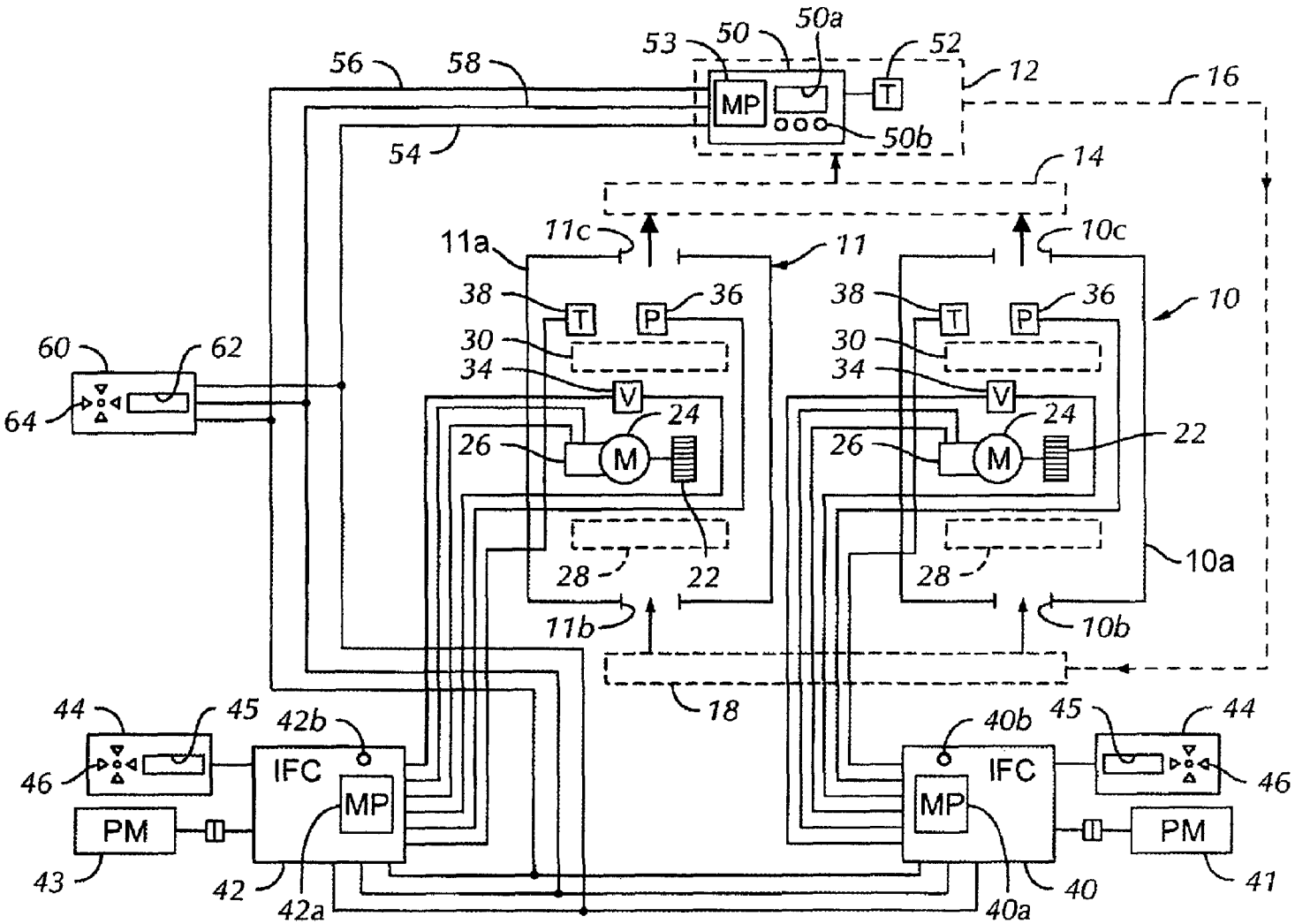
FIG. 1 is a schematic diagram showing two units of air conditioning equipment interconnected with a controller for determining if the units may be operated as twinned units.

In the description which follows, like elements are marked throughout the specification and drawing with the same reference numerals, respectively. The drawing figures are in somewhat schematic and generalized form in the interest of clarity and conciseness.

Referring to FIG. 1, there is illustrated a diagram of two units of air conditioning equipment indicated by the numerals 10 and 11, respectively. The air conditioning equipment units 10 and 11 are shown schematically as so-called twinned units wherein each unit is adapted to circulate conditioned air to an enclosed space 12 by way of a common plenum or duct 14. Accordingly, air is forced through the air conditioning units 10 and 11 into the common supply duct or plenum 14 and then to the space 12. Air is returned to the units 10 and 11 by way of a suitable duct, or set of ducts 16, to a common duct or plenum 18. The flow path of air is generally in accordance with the arrows indicated in FIG. 1.

The units of air conditioning equipment 10 and 11 may comprise equipment for both heating and cooling the space 12, heating only or cooling only. By way of example, the air conditioning units 10 and 11 are shown as combustion furnaces which also each include a cooling type heat exchanger. Each unit 10 and 11 of air conditioning equipment is provided with an air circulating blower 22, driven by a motor 24, each motor including a motor controller 26, operably connected thereto. The air conditioning units 10 and 11 each also include an air cooling heat exchanger 28, a heating type heat exchanger 30, which may be a combustion type furnace, including a combustion fuel control valve 34 and suitable sensors, including pressure and temperature sensors 36 and 38, for example. Air is circulated through respective cabinets 10*a* and 11*a* from air inlet openings 10*b* and 11*b* to air discharge openings 10*c* and 11*c*.

Control of the air conditioning units 10 and 11 is carried out by respective integrated controllers 40 and 42, which are connected to the motor controllers 26, the valves 34 and the sensors 36 and 38, among other items which may require control signals to be transmitted between the controllers and the air conditioning units proper. The controllers 40 and 42 may each include respective processors 40*a* and 42*a* each operably connected to a human interface unit 44 whereby certain control parameters may be input to the controllers 40 and 42, respectively, and certain operating parameters and conditions may be viewed by visual displays 45 on the respective interfaces. User controlled operations may be carried out by way of operation of suitable keypads 46, associated with the interface units 44, respectively. The interface units 44 may be of a type disclosed and claimed in co-pending patent application Ser. No. 11/906,678, filed Oct. 3, 2007 by Roger Boydstun, et al., and assigned to the Assignee of the present invention.

Accordingly, the interface units 44 may communicate with the respective processors 40*a* and 42*a*, respectively, comprising part of the integrated controllers 40 and 42, respectively. Still further, each of the controllers 40 and 42 may be operably connected to a so-called "personality" module or device 41 and 43, respectively, whereby information may be exchanged with the respective processors 40*a* and 42*a*, regarding specifications for the air conditioning units 10 and 11, respectively, including certain operating parameters, such as air conditioning capacities, and modes of operation of the respective units of air conditioning equipment 10 and 11. The "personality" modules or devices 41 and 43, are preferably of a type disclosed and claimed in co-pending patent application Ser. No. 11/717,466, filed Mar. 13, 2007, by Robert W. Helt, et al., and also assigned to the Assignee of the present invention. Information stored in the respective controllers 40 and 42, may be transferred to the modules or units 41 and 43, or information may be transferred to the respective controllers from the modules to configure the controllers for operation of the respective air conditioning units 10 and 11 at selected conditions of temperature, pressure and blower motor speed, for example. The modules 41 and 43 preferably include memory circuits and a connector for releasably connecting the modules to the controllers, for transferring information therebetween.

Referring still further to FIG. 1, the air conditioning units 10 and 11 are also operably connected to a controller or control unit 50, which may be characterized as a thermostat, disposed within the enclosed space 12 and including, inter alia, a temperature sensor 52. Controller or thermostat 50 preferably includes a visual display 50*a*, a user keypad 50*b* and a processor circuit 53 all operably interconnected. Controller 50 is interconnected with the controllers 40 and 42 by way of a data bus or communication path 54, and low voltage power supply conductors 56 and 58. A third interface 60 may also be connected to the controllers 40, 42 and 50, and be provided with a visual display 62 and a user operable keypad 64, as indicated in FIG. 1.

As mentioned previously, the modules or devices 41 and 43, may be programmed to store information concerning the specific type of apparatus comprising the units 10 and 11, for example. Examples of data which may be stored in the modules or devices 41 and 43, and transferred to the controllers 40 and 42, include the model and serial number of the respective units 10 and 11, air flow data, specific part numbers for replaceable parts, and other information necessary for operation of the respective units, including whether or not the units are multistage or single stage units, that is, units which have blowers 22, which operate at a constant speed or at variable speeds depending on the air heating or cooling capacity of the air conditioning units. Certain types of air conditioning units may not be interconnected or "twinned" with other units, including, for example, certain types of multistage combustion furnaces.

When two respective air conditioning units 10 and 11 are interconnected, as illustrated in FIG. 1, and their respective controllers interconnected on a data bus, such as the bus 54, the controllers 40 and 42, when powered, will each carry out a so-called initialization and self-check test, followed by test mode verifications and, finally, monitoring for signals to be received from the controller 50, indicating a call for heating or cooling of the space 12. When two or more units, such as the units 10 and 11, are interconnected to a controller, such as the controller 50, a program which may be resident on the processor 53, may provide for the respective controllers 40 and 42 to carryout the above-mentioned processes of self-check testing, test mode verification and monitoring the controller 50 for a signal for a call for heating or cooling of space 12. One of the process steps may be termed as "device discovery" in accordance with the protocol of the aforementioned program, once power-up has been carried out. The power-up or power applied step is followed by determining during the device discovery step, if twinning is allowed for either one of the units 10 or 11. Accordingly, the controllers 40 and 42 may be programmed, either initially or via the modules 41 and 43, to identify the units 10 or 11 as being capable of twinning.

Figure 2:
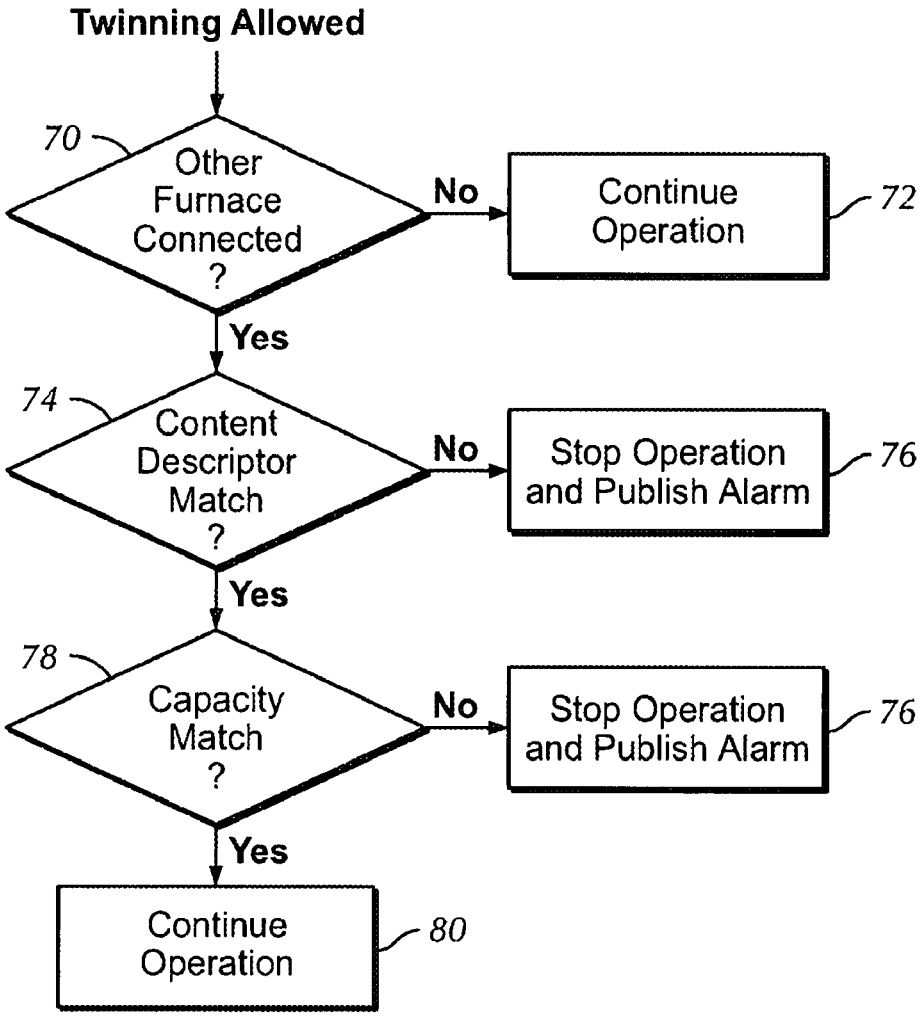
FIG. 2 is a flow diagram showing steps in determining if twinned units may be operated as such.

If twinning is allowed by the respective units 10 and 11, a process in accordance with FIG. 2 will be carried out, wherein at step 70, the process determines whether or not another air conditioning unit is connected to the control circuitry, including the signal path or bus 54. If the controller 50 determines that only one air conditioning unit is connected to the controller, then the process proceeds to normal operation as indicated at step 72 FIG. 2, and the controller 40 or 42 waits for a signal for a call for heating or cooling by way of the controller 50 and the sensor 52. If the controller 50 determines, in accordance with the process, that more than one air conditioning unit is connected to the controller 50, the process indicated in FIG. 2 proceeds to step 74, whereby the controller 50 compares certain information regarding the specifications or content descriptions of the respective units 10 and 11, as provided by the controllers 40 and 42, either initially or via information input by the modules or devices 41 and 43. If the specifications or content descriptions for the units 10 and 11 do not match for twinning operation, such as, for example, if the units are incompatible multistage furnaces, then the process proceeds to step 76, wherein operation of the units 10 and 11 is stopped and an alarm signal may be generated at displays 45 for both of the interfaces 44, and/or at display 50*a*, and/or by way of suitable indicators 40*b* and 42*b*, for example, associated with the controllers 40 and 42, respectively.

Accordingly, various levels of detection may be considered. A first level of detection may be known as determining the device type, that is by determining if the units 10 and 11 are both combustion furnaces, for example, or both are air handlers, for example. In the example of the process shown in FIG. 2, it has already been determined if twinning is allowed, since detection has indicated that the units 10 and 11 are of the same type of equipment. Step 74 in FIG. 2 is the second level of detection wherein it is determined if so-called content descriptors match. The content descriptor may be a unique number or identifier assigned to a so-called model family of similar units or products. For instance, a control program for a three-stage furnace would have a different content description or identifier than the control program for a two-stage furnace, so that different model families can be detected.

If the content descriptors match, say for example, the air conditioning units are both single-stage combustion furnaces with constant speed air circulation blowers, the process would proceed to step 78 to determine if the so-called capacities of the units 10 and 11 match. Twinning would not be permitted if the respective air conditioning unit capacities were not capable of delivery of essentially the same amount of air heating or cooling or be at least within a limited range of capacity. Depending on the extent of a product line produced by a manufacturer using the process of the invention, combustion furnaces, for example, in the same model family of air conditioning units might be capable of significantly different heat output capacities.

It is desirable to prevent operation of substantially mismatched combinations of air conditioning units. Accordingly, if the capacities match within the tolerances or ranges permitted by the designs of the air conditioning units 10 and 11, the process of FIG. 2 would proceed to step 80, wherein it is indicated that operation of the units 10 and 11 as twinned units, is permitted and both units would respond to a signal for a call for heating or cooling generated by the controller 50 and transferred to the controllers 40 and 42 and whereby the units 10 and 11 would operate simultaneously at the same capacity or performance level to provide the necessary heating or cooling of the space 12.

Figure 3:
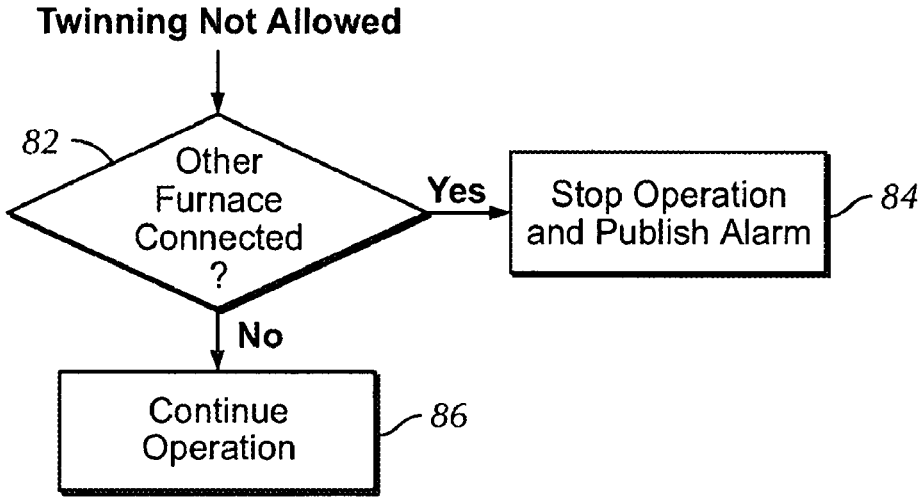
FIG. 3 is a flow diagram showing the steps of operating a unit of air conditioning equipment when twinning is not allowed.

Alternatively, if the control program for either of units 10 or 11 includes a suitable amount of code which advises that twinning is not allowed with a particular unit, the process would continue to step 82, as indicated in FIG. 3, to determine if another unit was connected to the controller 50. If the program indicated that a second unit was connected to the controller 50, the process would proceed to step 84 whereby an alarm signal would be generated at the controllers 40, 42 or 50 and/or an associated interface. Of course, if at step 82 it was determined that another unit of air conditioning equipment was not connected to the controller 50, then normal operation to provide heating or cooling would be carried out by the unit connected to the controller 50, for example, as indicated by step 86 in FIG. 3.

In the implementation of the method and system of the invention, if two air conditioning units, such as the units 10 and 11, have been interconnected, as indicated in the diagram of FIG. 1, upon powering up the system shown in FIG. 1, the controller 50 will typically cause the controllers 40 and 42 to perform self-tests and initializations and the controller 50 will read any inputs being produced in that part of the process. If an input to the controller 50 indicates that twinning is not allowed by either one of the units 10 and 11, the process proceeds to the steps of FIG. 3. If, during the self-test mode, the controller 50 determines that twinning is allowed by units 10 and 11, then the process of FIG. 2 is carried out to determine if the air conditioning units 10 and 11 are compatible in the sense of specification matching and capacity matching, for example.

The process of the invention and the system accomplishing same are believed to be within the purview of one skilled in the art based on the foregoing description. Although a preferred embodiment of the invention has been described in detail herein, those skilled in the art will recognize that various substitutions and modifications may be made without departing from the scope and spirit of the appended claims.

What is claimed is:

1. A method of controlling operation of multiple air conditioning units in an air conditioning system, the method comprising:

detecting whether at least one air conditioning unit is operatively connected to a common controller;

operating a first air conditioning unit if at least two air conditioning units are not detected after detecting the first air conditioning unit;

the common controller performing a verification test if at least a second air conditioning unit is detected to determine whether to permit operation of one or both of the first and the second air conditioning units, the verification test comprising:

communicating information between the common controller and a first controller and a second controller associated with the first and second air conditioning units, respectively, to determine compatibility between the first and second air conditioning units, comparing information communicated to the common controller by the first controller and the second controller, and the common controller determining whether the first and the second air conditioning units are compatible based on the information communicated by the first and the second controllers;

permitting operation of the first and the second air conditioning units if the common controller determines both first and second air conditioning units are compatible, each of the first and second air conditioning units being operable to circulate conditioned air to an enclosed space via a common duct; and preventing operation of one or both of the first and second air conditioning unit if the common controller determines both air conditioning units are incompatible.

2. The method of claim 1, wherein the first air conditioning unit and the second air conditioning unit are incompatible unless the common controller verifies each air conditioning unit is at least one of a similar model family and type.

3. The method of claim 1, wherein the first air conditioning unit and the second air conditioning unit are incompatible unless the common controller verifies each air conditioning unit is of a similar capacity.

4. The method of claim 3, wherein the first air conditioning unit and the second air conditioning unit are of similar capacities if each air conditioning unit is capable of delivering a similar amount of heating and/or cooling to the enclosed space.

5. The method of claim 3, wherein the first air conditioning unit and the second air conditioning unit are of similar capacities if each air conditioning unit has a heating and/or cooling capacity within a predetermined capacity range.

6. The method of claim 1, further comprising generating an alarm signal if the first air conditioning unit and the second air conditioning unit are incompatible.

7. The method of claim 3, wherein the common controller determines the first air conditioning unit and the second air conditioning unit are similar or different combustion furnaces based on the information communicated by the first controller and the second controller, respectively, the combustion furnaces being selected from a group comprising a single-stage combustion furnace, a two-stage combustion furnace, and a three-stage combustion furnace.

8. An air conditioning system comprising:

a common controller for controlling operation of air conditioning units within the air conditioning system; and at least a first controller and a second controller operatively connected to the common controller, the first and second controller each operable to control a first air conditioning unit and a second air conditioning unit, respectively, each of the first and second air conditioning units including a heat exchanger and an air blower for conditioning and circulating air to an enclosed space by way of a common duct;

wherein the common controller performs a verification test to determine whether to permit operation of one or both of the first and second air conditioning unit, the verification test comprising:

the common controller communicating with the first and second controller to determine compatibility between the first and second air conditioning units, respectively, and the common controller determining whether the first air and second air conditioning units are compatible by comparing information communicated by the first and second controller, wherein the common controller permits operation of the first and second air conditioning units if the common controller determines both air conditioning units are compatible, respectively; and wherein the common controller prevents operation of one or both of the first and second air conditioning units if the common controller determines both air conditioning units are incompatible.

9. The air conditioning system of claim 8, wherein the first air conditioning unit and the second air conditioning unit are incompatible and the common controller prevents operation of both air conditioning units unless the common controller verifies each air conditioning unit is at least one of a similar model family and type.

10. The air conditioning system of claim 8, wherein the first air conditioning unit and the second air conditioning unit are incompatible and the common controller prevents operation of both air conditioning units unless the common controller further verifies each air conditioning unit is of a similar capacity.

11. The air conditioning system of claim 10, wherein the first air conditioning unit and the second air conditioning unit are of similar capacities if each air conditioning unit is capable of delivering a similar amount of heating and/or cooling to the enclosed space.

12. The air conditioning system of claim 10, wherein the first air conditioning unit and the second air conditioning unit are of similar capacities if each air conditioning unit has a heating and/or cooling capacity within a predetermined capacity range.

13. The air conditioning system of claim 8, further comprising a user interface associated with of the common controller, the first air conditioning unit, and the second air conditioning unit, wherein an alarm signal is displayed on the user interface if the first air conditioning unit and the second air conditioning unit are incompatible.

14. The air conditioning system of claim 10, wherein the first air conditioning unit and the second air conditioning unit comprise similar or different combustion furnaces selected from a group comprising: a single-stage combustion furnace, a two-stage combustion furnace, and a three-stage combustion furnace.

15. The air conditioning system of claim 14, wherein the air blower of at least one of the first air conditioning unit and the second air conditioning unit comprises a variable speed air blower, and wherein the first air conditioning unit and the second air conditioning unit are incompatible if the air conditioning units are configured to provide conditioned air at different heat and/or airflow rates.

16. A method of controlling operation of multiple air conditioning units in an air conditioning system, the method comprising:

detecting whether at least one air conditioning unit is operatively connected to a common controller;

operating a first air conditioning unit if at least two air conditioning units are not detected after detecting the first air conditioning unit;

performing a verification test if at least a second air conditioning unit is detected to determine whether to permit operation of one or both of the first air and second air conditioning unit, the verification test comprising:

communicating information between the common controller and a first controller and a second controller to determine compatibility between the first and second air conditioning units, respectively, comparing information communicated to the common controller by the first and the second controllers; and the common controller determining whether the first and second air conditioning units are compatible based on the information communicated by the first and second controllers, respectively;

instructing the first and second controllers to simultaneously operate the first and second air conditioning units if the common controller determines the first and second air conditioning units are compatible; and preventing operation of one or both of the first and the second air conditioning unit if the common controller determines both air conditioning units are incompatible, wherein the first and second air conditioning units are compatible if each air conditioning unit is at least of a similar type and operable to deliver a similar quantity of conditioned air to an enclosed space via a common duct.

17. The method of claim 16, wherein the first air conditioning unit and the second air conditioning unit are incompatible unless the common controller verifies each air conditioning unit is of a similar model family.

18. The method of claim 16, wherein the first air conditioning unit and the second air conditioning unit are incompatible unless the common controller verifies each air conditioning unit has a heating and/or cooling capacity within a predetermined capacity range.

19. The method of claim 18, wherein the common controller determines the first air conditioning unit and the second air conditioning unit are similar or different combustion furnaces based on the information communicated by the first controller and the second controller, respectively, the combustion furnaces being selected from a group comprising a single-stage combustion furnace, a two-stage combustion furnace, and a three-stage combustion furnace.

* * * * *